US005711424A

United States Patent [19]

Kiesow

[11] Patent Number: 5,711,424

[45] Date of Patent: Jan. 27, 1998

[54] PACKAGED ONE-TIME-USE CAMERA AND ACCESSORY BELT CLIP

[75] Inventor: Ronald Herbert Kiesow, Rochester, N.Y.

[73] Assignee: Eastman Kodak Company, Rochester, N.Y.

[21] Appl. No.: 697,745

[22] Filed: Aug. 29, 1996

[51] Int. Cl.[6] ..... B65D 85/38

[52] U.S. Cl. ..... 206/316.2; 206/469; 396/6

[58] Field of Search ..... 206/461, 469, 206/316.1, 316.2, 320, 576, 578; 396/6

[56] References Cited

U.S. PATENT DOCUMENTS

| | | | |
|---|---|---|---|
| 681,392 | 8/1901 | Fugate | 224/271 |
| 3,209,968 | 10/1965 | Flanagan | 354/293 |
| 3,743,147 | 7/1973 | Wilczynski | 224/26 |
| 4,006,764 | 2/1977 | Yamamoto et al. | 206/320 |
| 4,403,717 | 9/1983 | Glover | 224/252 |
| 5,014,892 | 5/1991 | Copeland | 224/271 |
| 5,263,586 | 11/1993 | Keable | 206/469 |
| 5,285,228 | 2/1994 | VanDeMoere | 396/6 |
| 5,331,721 | 7/1994 | Raum, Sr. | 24/3 |
| 5,337,099 | 8/1994 | Tasaka et al. | 396/6 |
| 5,350,062 | 9/1994 | Takiguchi et al. | 206/316.1 |
| 5,624,033 | 4/1997 | Arai et al. | 206/469 |

*Primary Examiner*—David T. Fidei
*Attorney, Agent, or Firm*—Roger A. Fields

[57] ABSTRACT

A packaged camera comprising a one-time-use camera and a display package containing the one-time-use camera is characterized by: a tear-away extension of the display package having a suspension opening for receiving a support to hang the package for display purposes; an attachment means for securing the tear-away extension to the one-time-use camera when the tear-away extension is torn away from the display package and the one-time-use camera is removed from the display package; and a belt clip having a pair of opposite hook portions, one of which is configured to be received in the tear-away extension and the other of which is configured to be attached to a person's belt to be able to carry the one-time-use camera.

4 Claims, 2 Drawing Sheets

PACKAGED ONE-TIME-USE CAMERA AND ACCESSORY BELT CLIP

FIELD OF THE INVENTION

The invention relates generally to the field of photography, and in particular to a packaged one-time-use camera and accessory belt clip.

BACKGROUND OF THE INVENTION

A packaged camera comprising a one-time-use camera and a display package containing the one-time-use camera is generally known. Moreover, camera belt clips such as disclosed in U.S. Pat. No. 4,403,717 and No. 5,014,892 are generally known. However, the display package and the belt clip have never been integrated.

SUMMARY OF THE INVENTION

A packaged camera comprising a one-time-use camera and a display package containing the one-time-use camera, is characterized by:

a tear-away extension of the display package having a suspension opening for receiving a support to hang the package for display purposes;

attachment means for securing the tear-away extension to the one-time-use camera when the tear-away extension is torn away from the display package and the one-time-use camera is removed from the display package; and a belt clip having a pair of opposite hook portions, one of which is configured to be received in the tear-away extension and the other of which is configured to be attached to a person's belt to be able to carry the one-time-use camera.

DETAILED DESCRIPTION OF THE INVENTION

The invention is disclosed as being embodied preferably in a packaged one-time use camera. Because the features of a one-time-use camera are generally known, the description which follows is directed in particular only to those elements forming part of or cooperating directly with the disclosed embodiment. It is to be understood, however, that other elements may take various forms known to a person of ordinary skill in the art.

Figure 1:
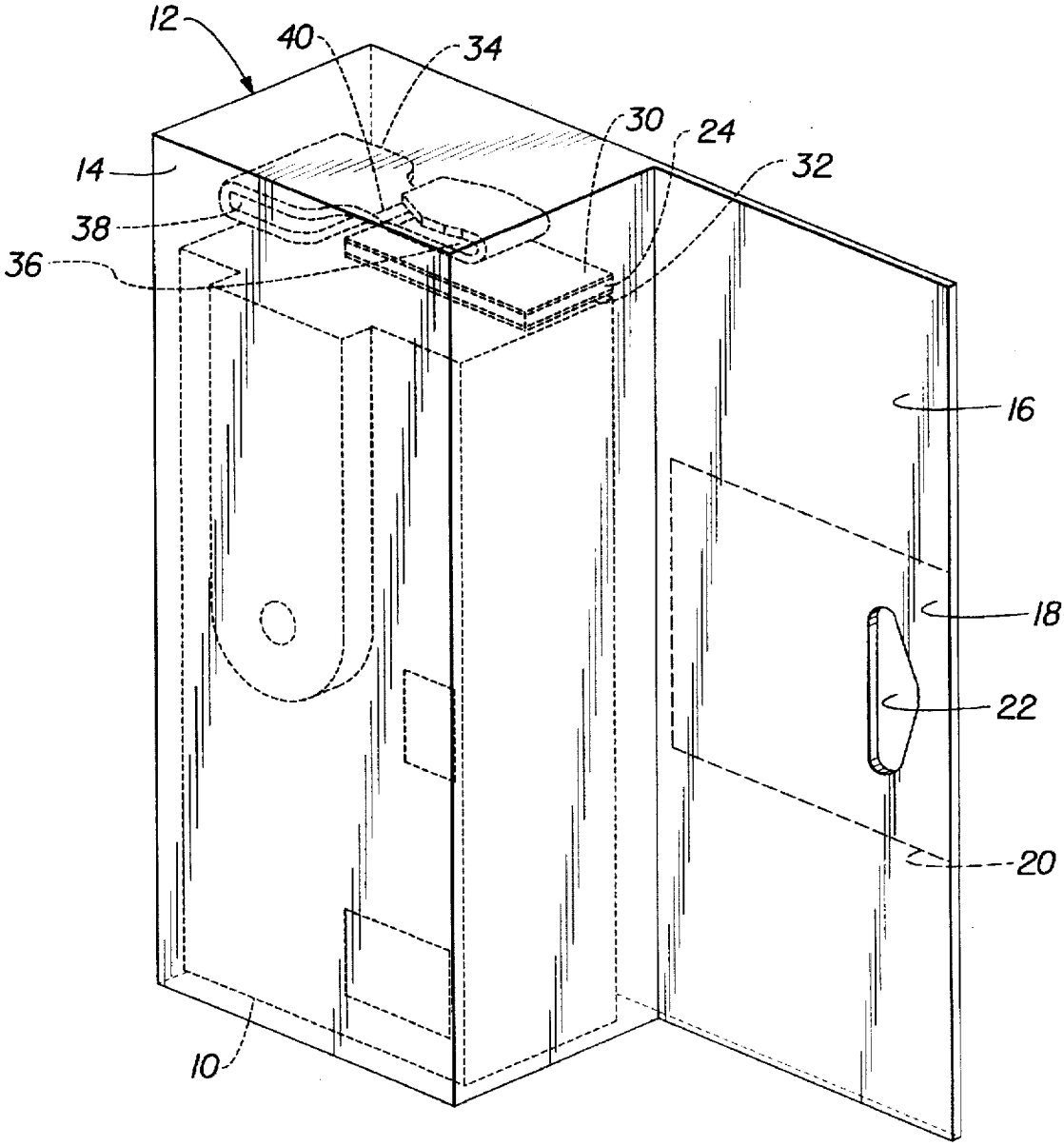
FIG. 1 is a front perspective view of a packaged one-time-use camera and accessory belt clip according to a preferred embodiment of the invention.

Referring now to the drawings, FIG. 1 shows a packaged camera comprising a one-time-use camera 10 and a display package 12 containing the one-time-use camera.

The display package 12 is a cardboard, box-like container 14 for the one-time-use camera 10 and it may include a front transparent portion, not shown, for viewing the one-time-use camera inside the box-like container. A flat extension 16 of the box-like container 14 has a tear-away portion 18 which is to be torn away from the flat extension along successive closely-spaced perforations 20 in the flat extension (for a purpose that is described below). See FIG. 1. The tear-away portion 18 has a suspension opening 22 for receiving a typical support, not shown, to hang the display package 12 for display purposes in a camera-sales store.

Figure 2:
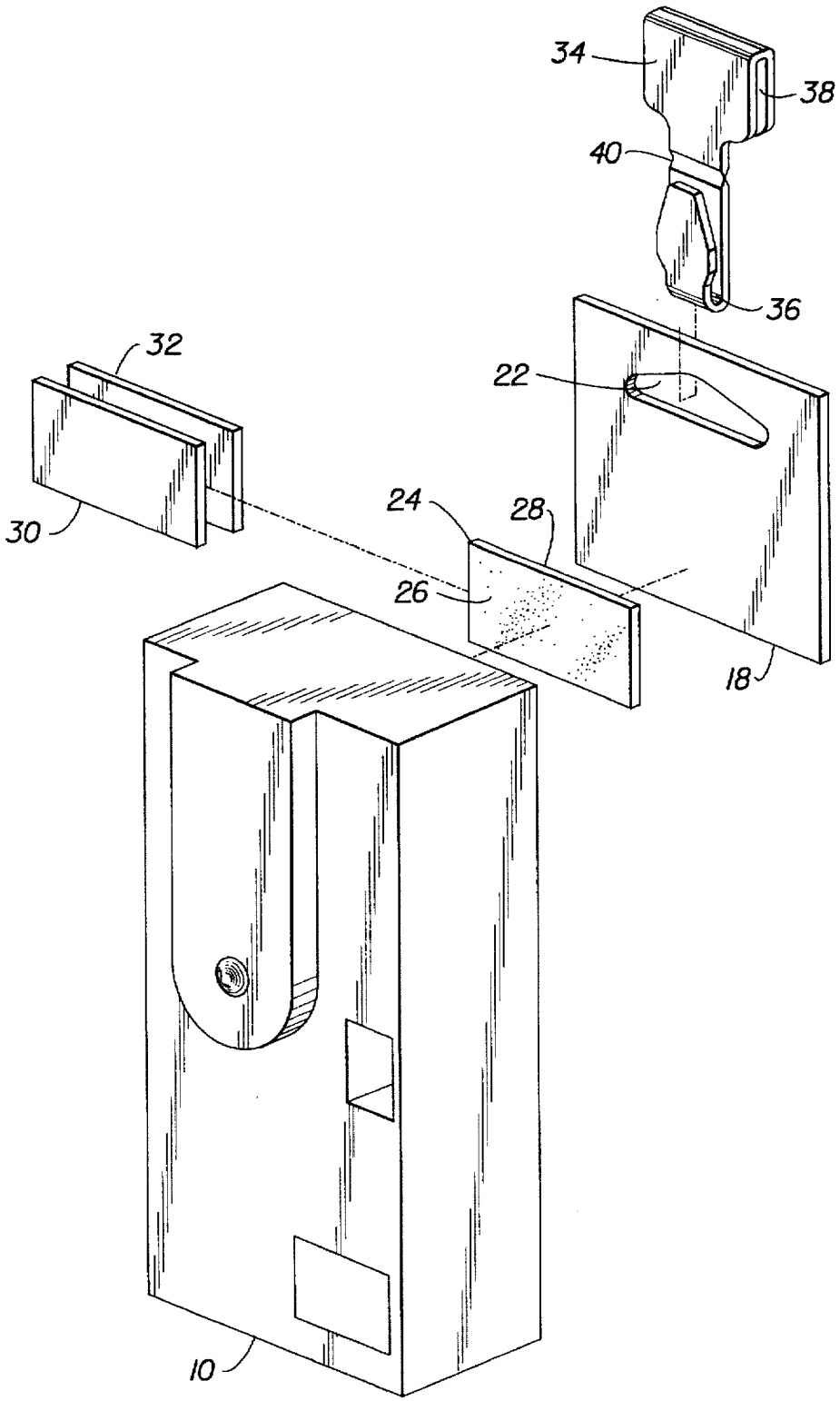
FIG. 2 is an exploded perspective view of the one-time-use camera and the belt clip indicating their manner of attachment.

An attachment means for securing the tear-away extension 18 to the one-time-use camera 10 when the tear-away extension is torn away from the box-like container 14 and the one-time-use camera is removed from the box-like container can take a number of known forms. For example, the attachment means can be a thin pad 24 having two opposite adhesive sides 26 and 28 and respective peel-away sheet covers 30 and 32 on the opposite adhesive sides. The peel-away covers 30 and 32 are to be removed from the opposite adhesive sides 26 and 28 to attach the individual adhesive sides to the tear-way extension 18 and the one-time-use camera 10. See FIGS. 1 and 2. The pad 24 is provided inside the box-like container 14.

A plastic belt clip 34 has a pair of opposite u-shaped hook portions 36 and 38. See FIGS. 1 and 2. One of the hook portions 36 is configured to be received in the suspension opening 22 of the tear-away portion 18 and the other hook portion 38 is configured to be attached to a person's belt to be able to carry the one-time-use camera 10 hanging from the belt clip and the tear-away portion 18. The belt clip 34 is provided inside the box-like container 14 and it has an integral "living hinge" 40 located between the pair of opposite hook portions 36 and 38. The hinge 40 allows the belt clip 34 to be bent at the hinge when the belt clip attached to a person's belt and the person is sitting The invention has been described with reference to a preferred embodiment. However, it will be appreciated that variations and modifications can be effected by a person of ordinary skill in the art without departing from the scope of the invention.

PARTS LIST

10. one-time-use camera
12. display package
14. box-like container
16. flat extension
18. tear-away portion
20. perforations
22. suspension opening
24. pad
26. adhesive side
28. adhesive side
30. peel-away cover
32. peel-away cover
34. belt clip
36. hook portion
38. hook portion
40. hinge

What is claimed is:

1. A packaged camera comprising a one-time-use camera and a display package containing said one-time-use camera, is characterized by:

a tear-away extension of said display package having a suspension opening for receiving a support to hang the package for display purposes;

attachment means for securing said tear-away extension to said one-time-use camera when the tear-away extension is torn away from said display package and the one-time-use camera is removed from the display package; and a belt clip having a pair of opposite hook portions, one of which is configured to be received in the suspension opening of said tear-away extension and the other of which is configured to be attached to a person's belt to be able to carry said one-time-use camera hanging from the person's belt.

2. A packaged camera as recited in claim 1, wherein said belt clip has an integral hinge located between said pair of opposite hook portions.

3. A packaged camera as recited in claim 1, wherein said attachment means and said belt clip are contained with said one-time-use camera in said display package.

4. A packaged camera as recited in claim 3, wherein said attachment means includes a pad having two opposite adhesive sides and respective peel-away covers on said adhesive opposite sides to be removed from the opposite adhesive sides to attach them to said tear-away extension and said one-time-use camera.

* * * * *